US011604055B2

(12) United States Patent
Birkin et al.

(10) Patent No.: US 11,604,055 B2
(45) Date of Patent: Mar. 14, 2023

(54) DETONATOR CONSTRUCTION

(71) Applicant: DETNET SOUTH AFRICA (PTY) LTD, Johannesburg (ZA)

(72) Inventors: Christopher Malcolm Birkin, Centurion (ZA); Michiel Jacobus Kruger, Johannesburg (ZA); Richard Joseph Michna, Barkhamsted, CT (US); Andre Louis Koekemoer, Boksburg (ZA); Mark Ivan Jurras, III, Canton, CT (US)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 128 days.

(21) Appl. No.: 17/422,639

(22) PCT Filed: Jan. 24, 2020

(86) PCT No.: PCT/ZA2020/050006
§ 371 (c)(1),
(2) Date: Jul. 13, 2021

(87) PCT Pub. No.: WO2020/160572
PCT Pub. Date: Aug. 6, 2020

(65) Prior Publication Data

US 2022/0090899 A1 Mar. 24, 2022

(30) Foreign Application Priority Data

Jan. 28, 2019 (ZA) ..... 2019/00554

(51) Int. Cl.
*F42D 1/05* (2006.01)
*F42D 1/04* (2006.01)

(52) U.S. Cl.
CPC ..... *F42D 1/043* (2013.01)

(58) Field of Classification Search
CPC ..... F42D 1/055; F42D 1/05; F42D 1/043; F42D 3/04; F42D 1/02; F42B 3/11; F42B 3/113

(Continued)

(56) References Cited

U.S. PATENT DOCUMENTS 5,101,727 A * 4/1992 Yarrington ..... F42B 3/113 102/201
5,133,257 A * 7/1992 Jonsson ..... F42B 3/18 102/210

(Continued)

FOREIGN PATENT DOCUMENTS

GB 2200977 A 8/1988
WO 2011044593 A1 4/2011
WO 2013131110 A1 9/2013

OTHER PUBLICATIONS

International Preliminary Report on Patentability for PCT/ZA2020/050006, dated Jan. 24, 2020, date of completion Dec. 7, 2020, 10 pages.

(Continued)

*Primary Examiner* — Michael D David
(74) *Attorney, Agent, or Firm* — Cantor Colburn LLP

(57) ABSTRACT

A detonator which includes a tube with an open end, a shock tube, secured to a plug which is fixed to an open end of the tube, an electronic module inside the tube, the module including a substrate which carries electronic components, and sensing structure mounted to the substrate spaced from an opposing end of the shock tube.

10 Claims, 2 Drawing Sheets

(58) Field of Classification Search
USPC ..... 102/206, 275.1–275.8, 215, 262, 217, 102/218; 361/248
See application file for complete search history.

(56) References Cited

U.S. PATENT DOCUMENTS 5,173,569 A * 12/1992 Pallanck ..... F42D 1/045 102/210
5,435,248 A * 7/1995 Rode ..... F42D 1/05 102/210
5,929,368 A * 7/1999 Ewick ..... F42C 11/06 102/210
5,942,718 A * 8/1999 Falquete ..... F42B 3/121 102/206
8,857,339 B2 * 10/2014 Muller ..... F42B 3/12 102/202.7
8,967,048 B2 3/2015 Harding et al.
9,146,084 B2 * 9/2015 Muller ..... F42B 3/121
9,625,244 B2 * 4/2017 Harding ..... G04F 10/00
2011/0155012 A1 * 6/2011 Perez Cordova ..... F42D 1/055 102/215
2013/0255521 A1 * 10/2013 Muller ..... F42B 3/12 102/202.7
2015/0013560 A1 * 1/2015 Schlenter ..... F42C 11/04 102/202.14

OTHER PUBLICATIONS

International Search Report for PCT/ZA2020/050006, dated Jan. 24, 2020, date of mailing May 6, 2020, 4 pages.
Written Opinion for PCT/ZA2020/050006, dated Jan. 24, 2020, date of mailing May 6, 2020, 6 pages.

* cited by examiner

DETONATOR CONSTRUCTION

CROSS-REFERENCE TO RELATED APPLICATIONS

This application is a U.S. national stage application of International Application No. PCT/ZA2020/050006 entitled "DETONATOR CONSTRUCTION", which has an international filing date of 24 Jan. 2020, and which claims priority to South African Patent Application No. 2019/00554, filed 28 Jan. 2019.

BACKGROUND OF THE INVENTION

This invention relates to constructional details of a detonator which is initiated by a shock tube event. This type of arrangement is described for example in the specification of U.S. Pat. No. 8,967,048.

In a detonator of the kind referred to, it is important for the various components of the detonator to be arranged in a particular configuration to ensure optimum reliability and safety. Arduous conditions can exist at a blast site and the detonators which are to be used must be capable of functioning reliably after being handled, and installed in demanding situations. In that respect physical factors relating to constructional aspects of the detonator are as important as electronic techniques which are used to validate and subsequently to implement a firing signal in a reliable manner consistent with designed parameters.

An object of the present invention is to provide a detonator which meets the aforementioned requirements.

SUMMARY OF THE INVENTION

The invention provides a detonator which includes a tubular casing with a closed end and an open end, a base charge inside the casing adjacent an inner surface of the closed end, an electronic module which is located inside the casing, the electronic module including a body of a plastics material, an electronic circuit which comprises a substrate and electronic components, at least a part of the electronic circuit being embedded in the plastics body with a portion of the substrate projecting from the body, the body including a first end which opposes the base charge and a second end from which said portion of the substrate projects, a housing which is mounted to the projecting portion of the substrate and which is spaced from the second end of the body, a sensing structure mounted to the substrate at the housing, a plug which is located at least partly in the open end of the casing and which is sealingly engaged with the casing, and a shock tube with an end which is secured to the plug and which opposes the sensing structure thereby to direct a shock tube event emitted at the end of the shock tube upon ignition of the shock tube, onto the sensing structure.

The casing may be made from any appropriate material e.g. a composite material, a plastics material or an appropriate metal or alloy.

A sensing component included in the electronic circuit may be located at the second end of the body positioned in the plastics material. The sensing component may be of any suitable kind. If the sensing component is a light sensor then at least a portion of the plastics material which overlies the light sensor is light transparent.

The plastics body may be formed with a first formation into which a part of the tubular casing can be crimped, in an interengaging manner, thereby to ensure that the body is correctly positioned inside the casing.

BRIEF DESCRIPTION OF THE DRAWINGS

The invention is further described by way of example with reference to the accompanying drawings in which.

DESCRIPTION OF PREFERRED EMBODIMENT

Figure 1:
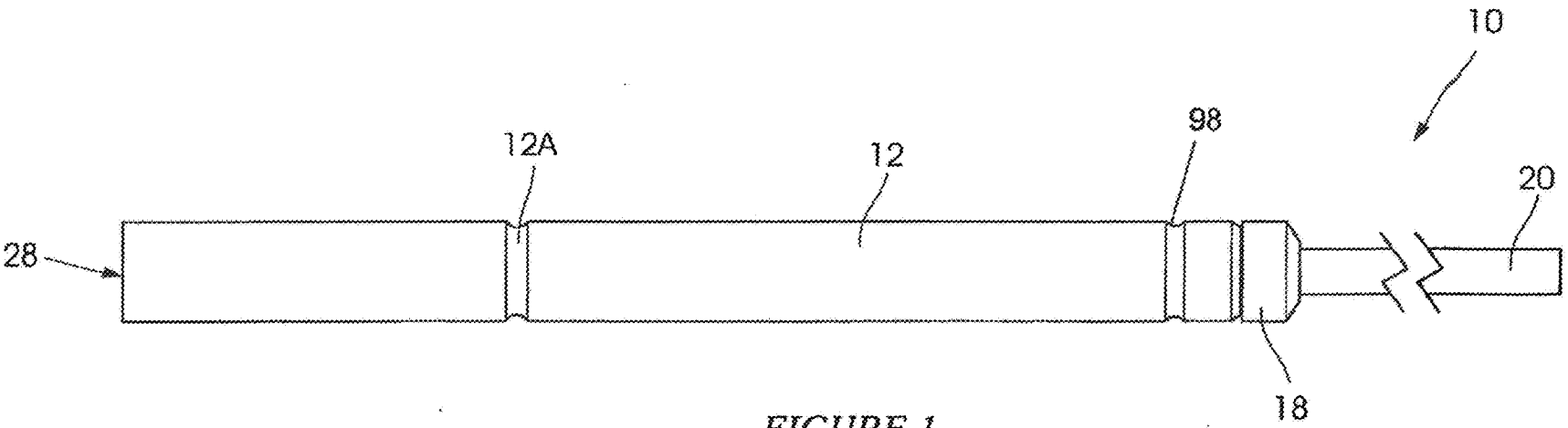
FIG. 1 is a side view of a detonator according to the invention.
Figure 2:
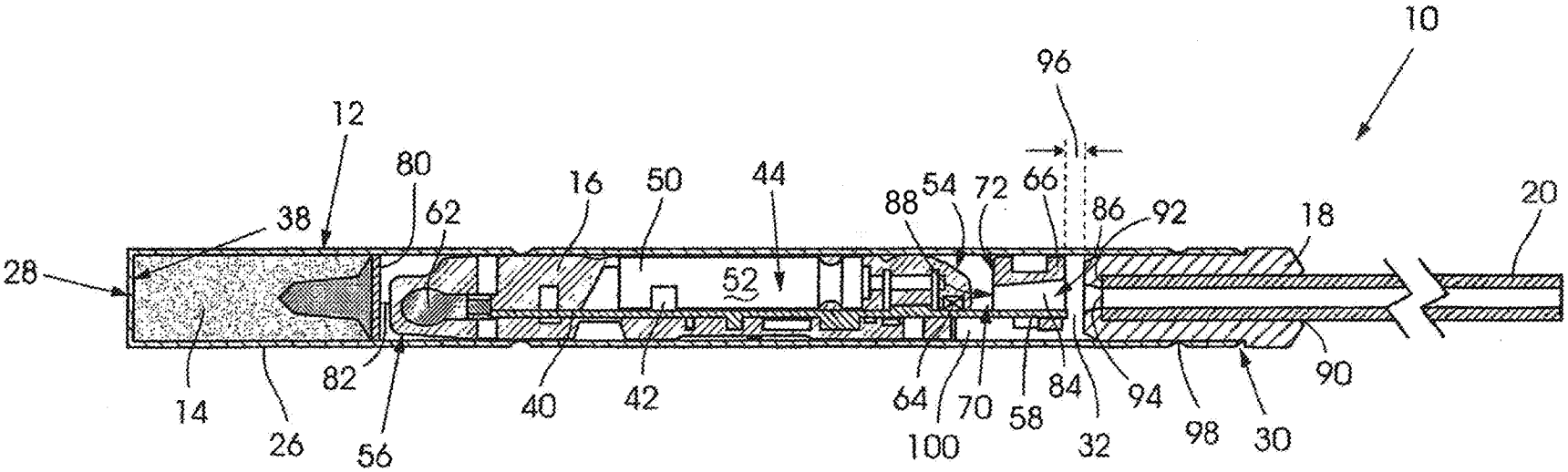
FIG. 2 illustrates from one side and in cross section constructional details of the detonator of FIG. 1.

FIG. 1 is a side view of a detonator 10 according to the invention. FIG. 2 illustrates from one side and in cross section the detonator 10.

The detonator 10 includes a tubular casing 12 of any suitable material, a base charge 14, an electronic module 16, a plug 18 and a shock tube 20.

In this example the tubular casing 12 includes a thin copper wall 26 and has a closed end 28, an open end or mouth 30 and a bore 32.

The base charge 14 is of a known composition of a kind used in detonators and is placed in the bore 32 of the casing 12 and moved to abut an inner surface 38 at the closed end 28.

The electronic module 16 includes a substrate 40 which embodies a printed circuit board. Various electronic components 42 are mounted to the substrate 40 and are interconnected in a known manner. Also mounted to the substrate 40 is a battery 44 which is used to power the detonator 10. The module 16 further includes a body 50 which is moulded from a transparent plastics material 52 in which the components 42, 44 and a greater portion of the substrate are embedded. The body has a first end 54 and a second end 56. A portion 58 of the substrate 40 projects from the first end 54. An ignition element 62 is located at the second end 56. A light sensor 64 is embedded in the body 50 at the first end 54.

A housing 66 is mounted to the projecting portion 58 of the substrate. Sensing structure 70 is mounted to the projecting portion 58 of the substrate 40. The housing 66 has an end 72 which is spaced from the first end 54 of the body 50.

The body 50 is cylindrical.

During assembly the module 16 is precisely positioned in the bore 32 using automated techniques, so that the second end 56 is spaced from an opposing surface 80 of the base charge 14 by a predetermined and controlled distance 82. The casing 12 is then crimped at a location 12A so that the casing is mechanically or frictionally locked to the module 16. A portion of the body 50 adjacent the crimp location 12A does not include any of the electronic components 42. Thus the body 50 can be cylindrically compressed during the crimping process without directing any resultant stress onto electronic components which could be damaged by that type of mechanical force.

The housing 66 is configured to fit with minimal clearance into the bore 32. A passage 84 extends through the housing 66 from an inlet 86 to an outlet 88.

The plug 18 has a central passage 90. An end 92 of the shock tube 20 is located in the passage 90 and secured thereto. A thin diaphragm 94 inside the plug 18 abuts the end 92 of the shock tube 20. The diaphragm 94 prevents the migration of a shock tube explosives composition to the housing 64. It is conceivable that particles from the explosives composition could interfere with the integrity and working of some of the electronic components 42 embodied in the module 16. The end 92 is spaced from the inlet 86 of the housing 66 by a distance 96 which is precisely controlled by automated means during assembly of the detonator 10. The plug 18 is fixed to the casing 12 by means of crimps 98. During the crimping process the plug 18 is compressed in one direction and expands in an axial direction towards the housing 66. The distance 96 becomes minimal.

In use of the detonator 10 the shock tube 20 is initiated and a shock tube event which contains plasma and light and which is accompanied by an increase in temperature and a pressure wave is emitted from the end 92, ruptures the diaphragm 94 and impacts on the housing 66. The passage 84 guides the shock tube event to the sensing structure 70 and to the light sensor 64. The sensing structure 70 and the light sensor 64 are designed to detect characteristics which are uniquely associated with a genuine shock tube event. These characteristics are validated by a circuit which is included in the components 42, and provided all aspects are determined to be functional, the battery 44 is used to provide energy to fire the ignition element 62 which, in turn, causes initiation of the base charge 14.

An important feature of the detonator 10 is that the electronic components 42 are held embedded in the plastics body 50. However, at least one characteristic of the shock tube event is detected by the sensing structure 70 which is spaced from the body 50. On the other hand a light signal which is also characteristic of the shock tube event, is detected by the sensor 64 which is protected by the transparent plastics material 52. In essence there is a serial arrangement in which the sensing structure 70 functions firstly and, although there is only a short time interval thereafter, the sensing component 64 then functions.

Figure 3:
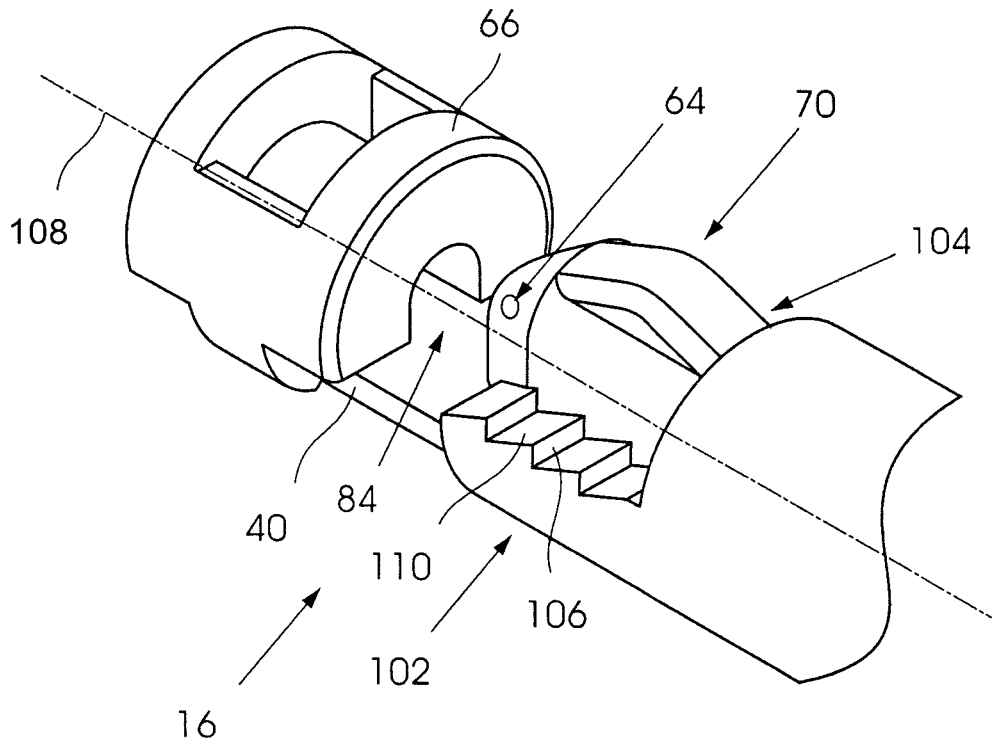
FIG. 3 is a perspective view of a portion of an electronic module included in the detonator.

The housing 66 is spaced from the first end 54 so that particles and energy associated with the shock tube event are allowed to dissipate at least to some extent into a volume 100 before the light signal reaches the first end 54 and the light sensor 64. In order to enhance such dissipation the first end 54, as is shown in FIG. 2, is tapered at least to some extent. Additionally the taper is flanked by formations 102 and 104, in the form of saw-tooth formations, (FIG. 3) which help to create turbulence and to trap particles, associated with the shock tube event, which otherwise might be reflected to the sensing structure 70. Only the formations 102 are shown in FIG. 3 but the formations 104, which are on an opposing side of the module 16 are similar to the formations 102. Each formation 102, 106 has a flat surface 106 which is transverse to a longitudinal axis 108 and a sloping surface 110 which is at an acute angle relative to the flat surface 106.

The invention claimed is:

1. A detonator which includes a tubular casing with a closed end and an open end, a base charge inside the casing adjacent an inner surface of the closed end, an electronic module which is located inside the casing, the electronic module including a body of a plastics material, an electronic circuit which comprises a substrate and electronic components, at least a part of the electronic circuit which includes the electronic components being embedded in the plastics body with a portion of the substrate projecting from the body, the body including a first end from which said portion of the substrate projects and a second end which opposes the base charge, a housing which is mounted to the projecting portion of the substrate and which is spaced from the first end of the body, the housing including a passage which extends through the housing from an inlet to an outlet, a sensing structure mounted to the substrate opposing the outlet from the housing, a plug which is located at least partly in the open end of the casing and which is sealingly engaged with the casing, and a shock tube with an end which is secured to the plug and which opposes the inlet to the housing thereby to direct a shock tube event emitted at the end of the shock tube upon ignition of the shock tube, through the passage onto the sensing structure.

2. A detonator according to claim 1 wherein the casing is made from any one of a composite material, a plastics material, and an appropriate metal or alloy.

3. A detonator according to claim 1 wherein the electronic circuit includes a sensing component which is located at the first end of the body positioned in the plastics material and wherein at least a portion of the plastics material which overlies the sensing component is light transparent.

4. A detonator according to claim 3 wherein the sensing component is a light sensor.

5. A detonator according to claim 1 wherein the plastics body is formed with a formation into which a part of the tubular casing is crimped, in an interengaging manner, thereby to ensure that the body is correctly positioned inside the casing.

6. A detonator according to claim 1 wherein the first end of the body opposing the outlet from the housing is tapered.

7. A detonator according to claim 2 wherein the electronic circuit includes a sensing component which is located at the first end of the body positioned in the plastics material and wherein at least a portion of the plastics material which overlies the sensing component is light transparent.

8. A detonator according to claim 2 wherein the plastics body is formed with a formation into which a part of the tubular casing is crimped, in an interengaging manner, thereby to ensure that the body is correctly positioned inside the casing.

9. A detonator according to claim 3 wherein the plastics body is formed with a formation into which a part of the tubular casing is crimped, in an interengaging manner, thereby to ensure that the body is correctly positioned inside the casing.

10. A detonator according to claim 4 wherein the plastics body is formed with a formation into which a part of the tubular casing is crimped, in an interengaging manner, thereby to ensure that the body is correctly positioned inside the casing.

* * * * *